US007942296B1

(12) United States Patent
Johnson

(10) Patent No.: US 7,942,296 B1
(45) Date of Patent: May 17, 2011

(54) COMBINED DIAPER BAG AND PURSE AND ASSOCIATED METHOD

(76) Inventor: Gabriela Johnson, Anaheim, CA (US)

( * ) Notice: Subject to any disclaimer, the term of this patent is extended or adjusted under 35 U.S.C. 154(b) by 762 days.

(21) Appl. No.: 11/906,698

(22) Filed: Oct. 3, 2007

Related U.S. Application Data

(60) Provisional application No. 60/849,738, filed on Oct. 6, 2006.

(51) Int. Cl.
*A45C 15/00* (2006.01)

(52) U.S. Cl. ..... 224/578; 190/108; 224/632; 224/608; 224/611; 224/652

(58) Field of Classification Search ..... 224/578, 224/632, 604, 608, 611, 652; 190/108
See application file for complete search history.

(56) References Cited

U.S. PATENT DOCUMENTS

D264,523 S * 5/1982 Stark ..... D3/287
D270,306 S * 8/1983 Stark ..... D3/287
D316,177 S * 4/1991 Strimpfel ..... D3/217
5,038,984 A * 8/1991 Izzo ..... 224/643
5,062,557 A 11/1991 Mahvi
5,402,869 A 4/1995 Saltzman
5,415,332 A * 5/1995 Kliot ..... 224/153
D420,792 S * 2/2000 Sakelliou et al. ..... D3/217
6,189,750 B1 * 2/2001 Von Neumann ..... 224/153
6,305,587 B1 * 10/2001 Miller ..... 224/153
6,460,746 B1 * 10/2002 Amram ..... 224/579
D500,590 S * 1/2005 Sachen ..... D3/216
7,152,772 B2 * 12/2006 Ukitsu et al. ..... 224/660
2004/0089687 A1 * 5/2004 Ammerman ..... 224/578

* cited by examiner

*Primary Examiner* — Tri M Mai

(57) ABSTRACT

A combined diaper bag and purse includes a diaper bag with a plurality of bottle-holding pouches formed at opposed lateral faces of the diaper bag, and a purse conjoining directly to an anterior face of the diaper bag and oppositely situated from a posterior face of the diaper bag. The apparatus further includes a mechanism for detaching the purse from the anterior face of the diaper bag, a primary harness directly anchored to a proximal face of the diaper bag, and a plurality of auxiliary harnesses is directly coupled to the posterior face of the diaper bag. The apparatus further includes a mechanism for independently and slidably biasing each one of the auxiliary harnesses along a linear and horizontal path extending along the posterior face of the diaper bag.

8 Claims, 2 Drawing Sheets

COMBINED DIAPER BAG AND PURSE AND ASSOCIATED METHOD

CROSS REFERENCE TO RELATED APPLICATIONS

This application claims the benefit of U.S. Provisional Application No. 60/849,738, filed Oct. 6, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to diaper bags and, more particularly, to a combined diaper bag and purse for easily storing and accessing a variety of infant contents.

2. Prior Art

One thing most new parents never fully adjust to is the arsenal of equipment that must always be kept on hand in order to keep a baby both comfortable and happy. A never-ending supply of disposable or cloth diapers, ointment and wipes, ensure that a baby's tender bottom is kept clean, dry and free of irritating and painful diaper rash. Fresh bottles of milk or sip cups of juice and water, must be stored within easy reach to satisfy an infant's empty belly or quench a toddler's thirst. Jars of baby food line cabinet shelves and fruit snacks and baby cookies provide a healthy treat for a grumbling child. Hard teething biscuits and cold teething rings massage sore gums and can calm a crying baby suffering through the onset of first teeth, while small toys, rattles, or a special blanket can entertain and comfort a cranky child.

Although these items can be readily stored at home, traveling with a newborn infant or toddler, is another matter altogether. Any parent knows the stress of trying to juggle the many items necessary while on the go. The plethora of goods needed to keep a baby clean, comfortable, full and entertained at home, are just as much, if not more so, needed on the road, where tempers can flare after even a small amount of time spent restrained in a car seat. Regardless of whether a family is engaged in cross-country travel, taking an overnight trip, or simply dropping the kids of at daycare, a multitude of items are needed for the journey. When traveling with an infant, most parents would not consider leaving home without a satchel or diaper bag crammed full of bottles, toys, snacks, diapers and a variety of other items that a child might need at a moment's notice.

While diaper bags and oversized sacks do offer a great deal of storage, there are some drawbacks to their use. Specifically, many parents have experienced the frustrating scenario of carrying a diaper bag and baby in one arm, while attempting to carry a purse or briefcase loaded with a wallet, cellular telephone, cosmetic bag and other personal belongings in the other. As can be imagined, attempting to carry more than one bag, as well as a child, can put a terrible strain on the neck, back and shoulders. Many attempt to solve this problem by storing their personal belongings such as their wallet, day planner and cellular telephone within the diaper bag, as opposed to carrying two separate bags. Unfortunately, upon arriving at their child's daycare center or a babysitter's home, the user must contend with the task of quickly retrieving their personal belongings from the bag, a time consuming hassle. Not surprisingly, in their rush to gather their belongings and head off on their way, many busy parents mistakenly leave important personal accessories within the bag, rendering them empty handed when these accessories are needed. Obviously, it would be advantageous to provide a means for simultaneously transporting baby goods, as well as personal belongings.

U.S. Pat. No. 5,062,557 to Mahvi discloses an infant care bag for storing bottles, diapers, Wet Wipes, and other infant care supplies comprised of a primary bag section and a removable auxiliary bag section. The primary bag section can be worn as a backpack with or without the removable auxiliary bag section. The primary bag section stores a variety of infant care supplies and perishable food items and can be used as a booster chair for dining. The removable auxiliary section provides additional storage space and has a compartment for storing a changing pad. The infant care bag is constructed of a fabric coated extruded plastic framework. A second embodiment disclosed in the infant care bag is fabricated from vacuum formed plastic. The infant care bag is therefore lightweight and easy to clean. Unfortunately, this prior art example does not provide a removable purse for storing a caretaker's personal supplies.

U.S. Pat. No. 5,402,869 to Saltzman discloses a dual-bag having a first, primary, diaper bag and a second, secondary mother's bag detachably secured to the first primary bag. One of side surfaces of the first, primary bag has first zipper-securing means, and one of the side surfaces of the second, secondary bag has second, cooperating zipper-securing means, for removably mounting the second, secondary bag to the first bag. Unfortunately, this prior art example does not provide various mechanisms for carrying the combined bag.

Accordingly, the present invention is disclosed in order to overcome the above noted shortcomings. The present invention satisfies such a need by providing an apparatus that is convenient and easy to use, lightweight yet durable in design, and designed for easily storing and accessing a variety of infant contents. The present invention is simple to use, inexpensive, and designed for many years of repeated use.

BRIEF SUMMARY OF THE INVENTION

In view of the foregoing background, it is therefore an object of the present invention to provide an apparatus for easily storing and accessing a variety of infant contents. These and other objects, features, and advantages of the invention are provided by a combined diaper bag and purse.

A combined diaper bag and purse includes a diaper bag with a plurality of bottle-holding pouches formed at opposed lateral faces of the diaper bag, and a purse conjoining directly to an anterior face of the diaper bag and oppositely situated from a posterior face of the diaper bag. Such a purse effectively has an outer perimeter spaced inwardly from a perimeter of the anterior face of the diaper bag and includes a strap with opposed ends directly coupled to lateral sides thereof and spaced from the posterior face of the purse. The purse further includes a plurality of externally situated pockets formed on an anterior face thereof.

The apparatus further includes a mechanism for conveniently detaching the purse from the anterior face of the diaper bag. Such a detaching mechanism includes a zipper continuously extending along a predetermined path formed on the anterior face of the diaper bag. Such a predetermined path is substantially rectangular and coextensively shaped as a posterior face of the purse such that the purse directly abuts against the anterior face of the diaper bag and sits medially thereof.

The apparatus further includes a primary harness directly anchored to a proximal face of the diaper bag and advantageously arranged in such a manner that the purse remains anterior of the primary harness when the primary harness is positioned over a user shoulder. A plurality of auxiliary harnesses is directly coupled to the posterior face of the diaper bag. Such auxiliary harnesses protrude outwardly from the posterior face of the diaper bag while the primary harness protrudes upwardly from the proximal face of the diaper such that the primary and auxiliary harnesses remain untangled during transport. The distal ends of each of the auxiliary harness converge effectively towards a center of the bottom edge and form an apex defined at the bottom edge.

The apparatus further includes a mechanism for independently and slidably biasing each one of the auxiliary harnesses along a linear and horizontal path extending along the posterior face of the diaper bag. Such a biasing mechanism includes a track formed along the posterior face of the diaper bag and conveniently spanning along a major latitudinal length thereof. Such a track has a plurality of anchor brackets formed therein and is freely positional along an entire longitudinal length of the track. A plurality of clasps is directly coupled to the anchor brackets and proximal ends of each of the auxiliary harnesses while distal ends of each of the auxiliary harnesses are fixedly and statically connected directly to a bottom edge of the posterior face such that the distal ends of the auxiliary harnesses maintain a fixed spatial relationship while the clasps diverge and converge along the linear path.

A method for utilizing a combined diaper bag and purse to easily store and access a variety of infant contents includes the steps of: providing a diaper bag including a plurality of bottle-holding pouches formed at opposed lateral faces of the diaper bag; detachably conjoining a purse directly to an anterior face of the diaper bag by oppositely situating the purse from a posterior face of the diaper bag, the purse having a outer perimeter spaced inwardly from a perimeter of the anterior face of the diaper bag; anchoring a primary harness directly to a proximal face of the diaper bag by arranging the primary harness in such a manner that the purse remains anterior of the primary harness when the primary harness is positioned over a user shoulder; directly coupling a plurality of auxiliary harnesses to the posterior face of the diaper bag; and independently and slidably biasing each one of the auxiliary harnesses along a linear and horizontal path extending along the posterior face of the diaper bag.

The method further includes the steps of: anchoring a plurality of brackets to the track; freely positioning the brackets along an entire longitudinal length of the track; directly coupling plurality of clasps to the anchor brackets and proximal ends of each of the auxiliary harnesses; fixedly and statically connecting distal ends of each of the auxiliary harnesses directly to a bottom edge of the posterior face; and while diverging and converging the clasps along the linear path, maintaining a fixed spatial relationship between the distal ends of the auxiliary harnesses.

The method further includes the steps of: providing a zipper continuously extending along a predetermined path formed on the anterior face of the diaper bag; directly coupling opposed ends of a strap to lateral sides of the purse by spacing the strap from the posterior face of the purse; outwardly protruding the auxiliary harnesses from the posterior face of the diaper bag; and protruding the primary harness upwardly from the proximal face of the diaper such that the primary and auxiliary harnesses remain untangled during transport.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
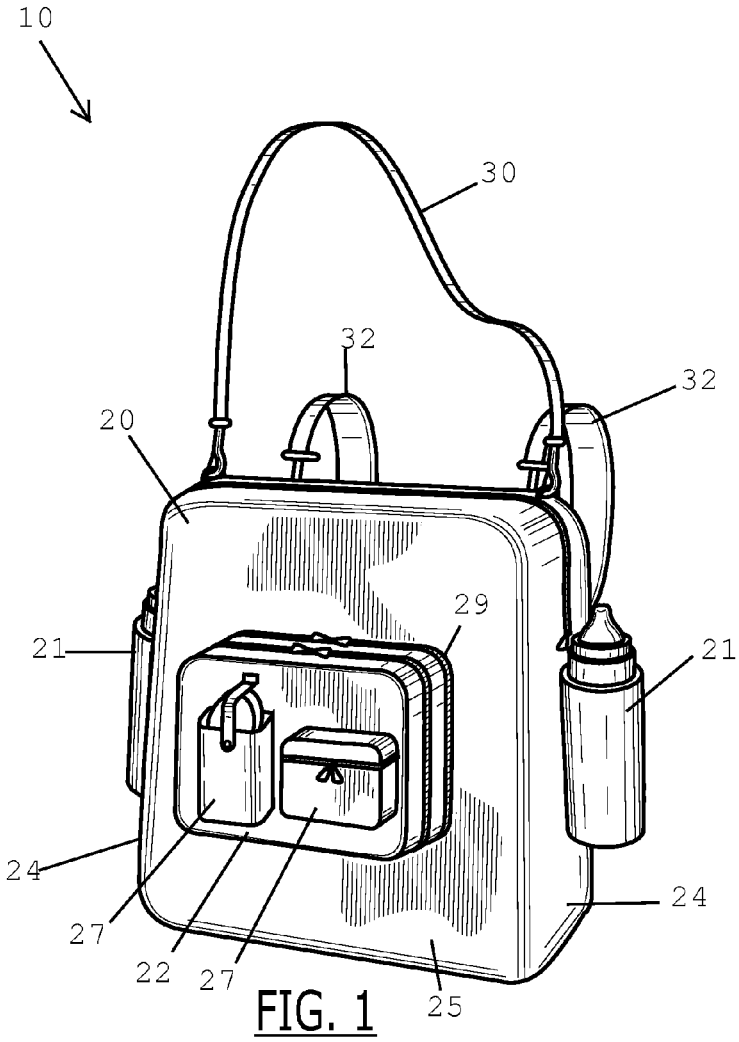
FIG. 1 is a perspective view showing a combined diaper bag and purse, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to protect a combined diaper bag and purse. It should be understood that the apparatus 10 may be used with many different types of bags and purses and should not be limited in use with only those types of bags and purses mentioned herein.

Figure 2:
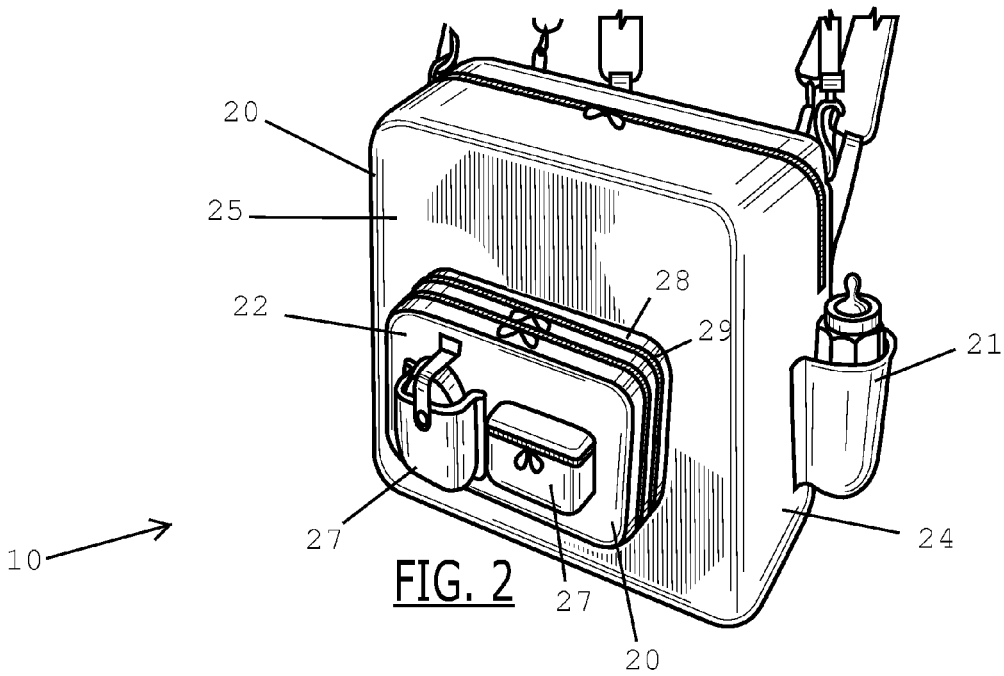
FIG. 2 is a perspective view showing the anterior face of a combined diaper bag and purse, in accordance with the present invention.
Figure 3:
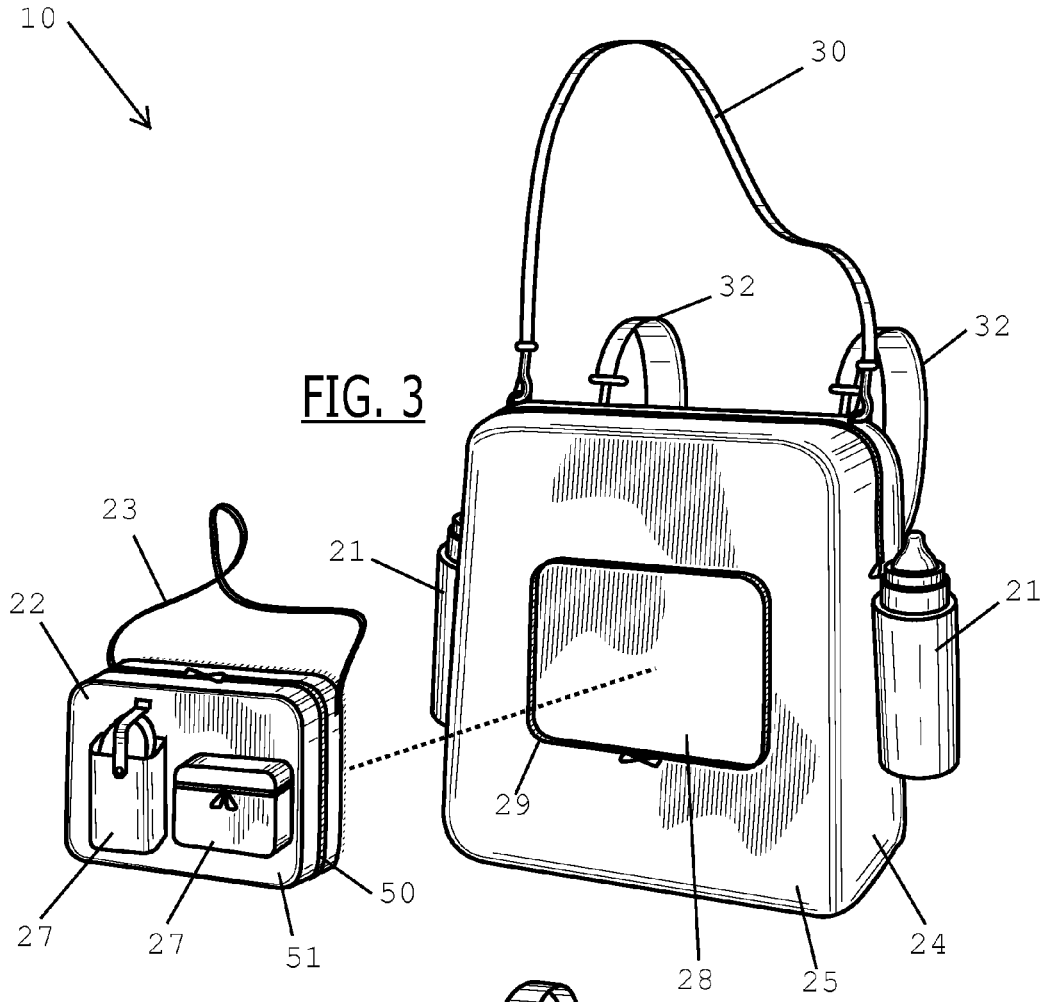
FIG. 3 is a perspective view of a combined diaper bag and purse, showing the removability of the purse, in accordance with the present invention.

Referring initially to FIGS. 1, 2, and 3, a combined diaper bag and purse 10 includes a diaper bag 20 with a plurality of bottle-holding pouches 21 formed at opposed lateral faces 24 of the diaper bag 20, and a purse 22 conjoining directly, without the use of intervening elements, to an anterior face 25 of the diaper bag 20 and oppositely situated from a posterior face 26 of the diaper bag 20. Such a purse 22 has an outer perimeter spaced inwardly from a perimeter of the anterior face 25 of the diaper bag 20 and includes a strap 23 with opposed ends directly coupled, without the use of intervening elements, to lateral sides 50 thereof and spaced from the posterior face of the purse. The purse 22 further includes a plurality of externally situated pockets 27 formed on an anterior face 51 thereof. The purse 22 should generally be used for storing a caretaker's personal suppliers because the purse 22 can be easily detached from the diaper bag 20 whenever necessary.

Referring to FIGS. 2 and 3, the apparatus 10 further includes a mechanism 28 for detaching the purse 22 from the anterior face 25 of the diaper bag 20. Such a detaching mechanism 28 includes a zipper 29 continuously extending along a predetermined path formed on the anterior face 25 of the diaper bag 20. Such a predetermined path is substantially rectangular and coextensively shaped as a posterior face of the purse which is essential such that the purse 22 directly abuts, without the use of intervening elements, against the anterior face 25 of the diaper bag 20 and sits medially thereof. The detaching mechanism 28 is provided for detaching the purse 22 from the diaper bag 20.

Referring to FIGS. 1, 2, 3 and 4, the apparatus 10 further includes a primary harness 30 directly anchored, without the use of intervening elements, to a proximal face 31 of the diaper bag 20 and arranged in such a manner that the purse 22 remains anterior of the primary harness 30 when the primary harness 30 is positioned over a user shoulder. A plurality of auxiliary harnesses 32 is directly coupled, without the use of intervening elements, to the posterior face 26 of the diaper bag. Such auxiliary harnesses 32 protrude outwardly from the posterior face 26 of the diaper bag 20 while the primary harness 30 protrudes upwardly from the proximal face 31 of the diaper which is important such that the primary 30 and auxiliary 32 harnesses remain untangled during transport. The distal ends 33 of each of the auxiliary harness 32 converge towards a center of the bottom edge and form an apex defined at the bottom edge. The primary harness 30 is provided for carrying the apparatus 10 over a user shoulder while the auxiliary harnesses 32 is used for carrying the apparatus 10 over a user back.

Figure 4:
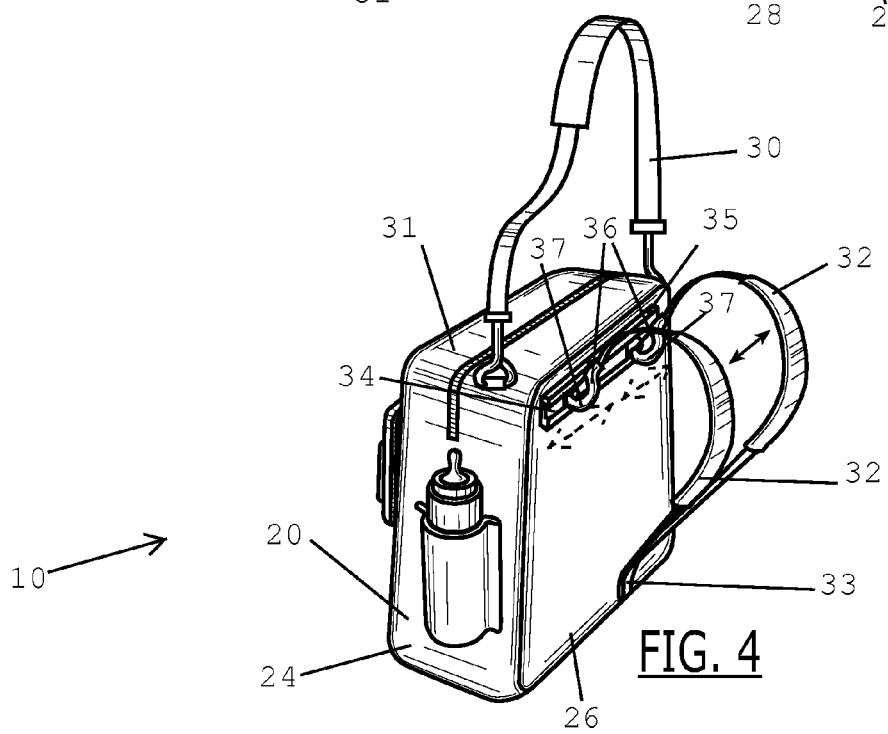
FIG. 4 is a perspective view of a combine diaper bag and purse, showing the posterior face of the diaper bag, in accordance with the present invention.

Referring to FIG. 4, the apparatus 10 further includes a mechanism 34 for independently and slidably biasing each one of the auxiliary harnesses 32 along a linear and horizontal path extending along the posterior face 26 of the diaper bag 20. Such a biasing mechanism 34 includes a track 35 formed along the posterior face 26 of the diaper bag 20 and spanning along a major latitudinal length thereof. Such a track 35 has a plurality of anchor brackets 36 formed therein and is freely positional along an entire longitudinal length of the track 35. A plurality of clasps 37 is directly coupled, without the use of intervening elements, to the anchor brackets 36 and proximal ends of each of the auxiliary harnesses 32 while distal ends 33 of each of the auxiliary harnesses 32 are fixedly and statically connected directly, without the use of intervening elements, to a bottom edge of the posterior face 26 which is vital such that the distal ends 33 of the auxiliary harnesses 32 maintain a fixed spatial relationship while the clasps 37 diverge and converge along the linear path.

In use, the combined diaper bag and purse is simple and straightforward to operate. First, the parent or caretaker simply fills the various pockets and pouches of the care bag and secondary bag with whatever items they need for travel with their infant. By way of example, the diaper bag can be loaded with diapers, baby bottles, pacifiers and similar accessories, while the secondary bag is utilized to store such items as a wallet, cellular telephone and house keys. Once both bags are filled with necessities, the user secures the secondary bag to the front of the diaper bag via the corresponding zipper closures. Carrying the diaper bag via the single shoulder strap or as a backpack carrier utilizing both shoulder straps, the user then simply carries this two-in-one carryall with them as they headed out for their scheduled activities. The user can go about these activities content in the knowledge that they have everything they needed for their child within easy reach. If dropping one's child off at Grandma and Grandpa's, a daycare center or with a babysitter, the user simply detaches the secondary bag from the diaper bag, leaving the bag with the caregiver and taking their items with them when they go. The user can quickly and easily remove and replace items from either bag as needed.

The invention includes a diaper bag that has a plurality of compartments for use in neatly storing and easily accessing a wide variety of infant necessities. Of course, a variety of alternate items may be housed within the compartments, as is obvious to a person of ordinary skill in the art. The assembly also includes a detachable secondary bag inside of which personal items such as a wallet, cellular telephone and other amenities are easily stored and quickly accessed. The diaper and secondary bags are produced of micro fiber nylon material that is durable in nature yet lightweight, which is important for minimizing that overall weight of the assembly. The diaper bag is a square shaped and measuring 12 inches in length, 12 inches in width and 5 inches in depth. The secondary bag is rectangular shaped and measures 10 inches in length, 8 inches in width and 2 inches in depth.

The diaper bag has a variety of ample storage compartments, inside of which necessities such as diapers, baby wipes, a changing mat, baby bottles and small toys and snacks can advantageously be neatly stored and easily accessed. To facilitate ease of transport, the diaper bag further has an adjustable carrying strap that is worn over the user's shoulder, as well as two, adjustable and detachable shoulder straps that conveniently enable a user to wear the assembly in a similar manner as a backpack. The detachable secondary bag is directly secured to the front of the diaper bag via corresponding zipper closures which run the outer perimeter of the rear surface of the secondary bag and the front surface of the diaper bag, respectively. Of course, the secondary bag may be attached at an alternate position, as is obvious to a person of ordinary skill in the art.

The secondary bag is produced of the same nylon material as the diaper bag, and has an ample flap closure which encompasses the front of the bag. A plurality of storage compartments and pouches are formed at the interior of the secondary bag. Positioned beneath the flap closure on the front of the secondary bag is a rectangular pocket for use in storing a cellular telephone, as well as an ample pocket for keys, while the interior pouch can be utilized to store a wallet, day planner, cosmetics bag and similar personal items. The various compartments incorporated into the design of the assembly are held securely closed by standard zipper fasteners. Of course, Velcro® or snap fasteners may also be employed, as is obvious to a person of ordinary skill in the art. Furthermore, of course, the assembly can be produced in a variety of attractive colors and printed designs, as well as in neutral hues of beige, black or white, as is obvious to a person of ordinary skill in the art.

The present invention, as claimed, provides the unexpected and unpredictable benefit of an assembly that is convenient and easy to use, is durable yet lightweight in design, is versatile in its uses, and provides parents of infant children a clever alternative to cumbersome diaper bags and one which enables them to store all of the necessities for their baby, as well as their own personal use, in one, simple to use unit. The present invention ensures that baby goods and personal items are stored, transported and accessed in a neat and efficient manner. By eliminating the need to carry two separate bags in order to transport both baby accessories and personal belongings, use of the assembly also spares the user the hassle of storing their personal belongings within their child's diaper bag and then having to dig through the bag to retrieve these goods before dropping the child off at day care or an afternoon play date. Through offering organized and efficient storage, both the infant care bag and the secondary bag ensure that important items are always within reach and stored in an organized manner. Further, because the assembly boasts both a single and dual shoulder straps, users can carry heavier loads on their back, thus ensuring that the weight of the contained goods are evenly distributed across the body, eliminating stress and strain on the neck and shoulder area. Being ideal for household use, day care providers, nannies and similar professionals also appreciate the many benefits this unique assembly affords.

In use, a method for utilizing a combined diaper bag and purse to easily store and access a variety of infant contents includes the steps of: providing a diaper bag 20 including a plurality of bottle-holding pouches 21 formed at opposed lateral faces 24 of the diaper bag 20; detachably conjoining a purse 22 directly to an anterior face 25 of the diaper bag 20 by oppositely situating the purse 22 from a posterior face 26 of the diaper bag 20, the purse 22 having a outer perimeter spaced inwardly from a perimeter of the anterior face 25 of the diaper bag 20; anchoring a primary harness 30 directly to a proximal face 31 of the diaper bag 20 by arranging the primary harness 30 in such a manner that the purse 22 remains anterior of the primary harness 30 when the primary harness 30 is positioned over a user shoulder; directly coupling a plurality of auxiliary harnesses 32 to the posterior face 26 of the diaper bag 20; and independently and slidably biasing each one of the auxiliary harnesses 32 along a linear and horizontal path extending along the posterior face 26 of the diaper bag 20.

In use, the method further includes the steps of: anchoring a plurality of brackets 36 to the track 35; freely positioning the brackets 36 along an entire longitudinal length of the track 35; directly coupling plurality of clasps 37 to the anchor brackets 36 and proximal ends of each of the auxiliary harnesses 32; fixedly and statically connecting distal ends 33 of each of the auxiliary harnesses 32 directly to a bottom edge of the posterior face 26; and while diverging and converging the clasps 37 along the linear path, maintaining a fixed spatial relationship between the distal ends 33 of the auxiliary harnesses 32.

In use, the method further includes the steps of: providing a zipper 29 continuously extending along a predetermined path formed on the anterior face 25 of the diaper bag 20; directly coupling opposed ends of a strap 23 to lateral sides of the purse 22 by spacing the strap 23 from the posterior face of the purse 22; outwardly protruding the auxiliary harnesses 32 from the posterior face of the diaper bag 20; and protruding the primary harness 30 upwardly from the proximal face of the diaper such that the primary and auxiliary harnesses 30, 32 remain untangled during transport.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined diaper bag and purse for easily storing and accessing a variety of infant contents, said combined diaper bag and purse comprising:

a diaper bag;

a purse conjoining directly to an anterior face of said diaper bag and oppositely situated from a posterior face of said diaper bag;

means for detaching said purse from said anterior face of said diaper bag;

a primary harness directly anchored to a proximal face of said diaper bag and arranged in such a manner that said purse remains anterior of said primary harness when said primary harness is positioned over a user shoulder;

a plurality of auxiliary harnesses directly coupled to said posterior face of said diaper bag;

means for independently and slidably biasing each one of said auxiliary harnesses along a linear and horizontal path extending along said posterior face of said diaper bag;

wherein said biasing means comprises:

a track formed along said posterior face of said diaper bag and spanning along a major latitudinal length thereof, said track having a plurality of anchor brackets formed therein and being freely positional along an entire longitudinal length of said track; and a plurality of clasps directly coupled to said anchor brackets and proximal ends of each of said auxiliary harnesses while distal ends of each of said auxiliary harnesses are fixedly and statically connected directly to a bottom edge of said posterior face such that said distal ends of said auxiliary harnesses maintain a fixed spatial relationship while said clasps diverge and converge along said linear path;

wherein said distal ends of each of said auxiliary harness converge towards a center of said bottom edge and form an apex defined at said bottom edge.

2. The combined diaper bag and purse of claim 1, wherein said detaching means comprises: a zipper continuously extending along a predetermined path formed on said anterior face of said diaper bag, said predetermined path being substantially rectangular and coextensively shaped as a posterior face of said purse such that said purse directly abuts against said anterior face of said diaper bag and sits medially thereof.

3. The combined diaper bag and purse of claim 1, wherein said purse comprises: a strap having opposed ends directly coupled to lateral sides thereof and spaced from said posterior face of said purse, said purse further including a plurality of externally situated pockets formed on an anterior face thereof.

4. The combined diaper bag and purse of claim 1, wherein said auxiliary harnesses protrude outwardly from said posterior face of said diaper bag while said primary harness protrudes upwardly from said proximal face of said diaper such that said primary and auxiliary harnesses remain untangled during transport.

5. A combined diaper bag and purse for easily storing and accessing a variety of infant contents, said combined diaper bag and purse comprising:

a diaper bag including a plurality of bottle-holding pouches formed at opposed lateral faces of said diaper bag;

a purse conjoining directly to an anterior face of said diaper bag and oppositely situated from a posterior face of said diaper bag, said purse having a outer perimeter spaced inwardly from a perimeter of said anterior face of said diaper bag;

means for detaching said purse from said anterior face of said diaper bag;

a primary harness directly anchored to a proximal face of said diaper bag and arranged in such a manner that said purse remains anterior of said primary harness when said primary harness is positioned over a user shoulder;

a plurality of auxiliary harnesses directly coupled to said posterior face of said diaper bag;

means for independently and slidably biasing each one of said auxiliary harnesses along a linear and horizontal path extending along said posterior face of said diaper bag;

wherein said biasing means comprises:

a track formed along said posterior face of said diaper bag and spanning along a major latitudinal length thereof, said track having a plurality of anchor brackets formed therein and being freely positional along an entire longitudinal length of said track; and a plurality of clasps directly coupled to said anchor brackets and proximal ends of each of said auxiliary harnesses while distal ends of each of said auxiliary harnesses are fixedly and statically connected directly to a bottom edge of said posterior face such that said distal ends of said auxiliary harnesses maintain a fixed spatial relationship while said clasps diverge and converge along said linear path;

wherein said distal ends of each of said auxiliary harness converge towards a center of said bottom edge and form an apex defined at said bottom edge.

6. The combined diaper bag and purse of claim 5, wherein said detaching means comprises: a zipper continuously extending along a predetermined path formed on said anterior face of said diaper bag, said predetermined path being substantially rectangular and coextensively shaped as a posterior face of said purse such that said purse directly abuts against said anterior face of said diaper bag and sits medially thereof.

7. The combined diaper bag and purse of claim 5, wherein said purse comprises: a strap having opposed ends directly coupled to lateral sides thereof and spaced from said posterior face of said purse, said purse further including a plurality of externally situated pockets formed on an anterior face thereof.

8. The combined diaper bag and purse of claim 5, wherein said auxiliary harnesses protrude outwardly from said posterior face of said diaper bag while said primary harness protrudes upwardly from said proximal face of said diaper such that said primary and auxiliary harnesses remain untangled during transport.

* * * * *